US007175710B2

(12) United States Patent
Metzger et al.

(10) Patent No.: US 7,175,710 B2
(45) Date of Patent: Feb. 13, 2007

(54) APPARATUS FOR STRIPPING A BOUNDARY AIR LAYER FROM A TRAVELING WEB

(75) Inventors: Rolf Metzger, Dietlikon (CH); Luca Frediani, Zürich (CH); Bruno Holtmann, Dielsdorf (CH); Hans Hardegger, Greifensee (CH)

(73) Assignee: Bachofen + Meier AG Maschinenfabrik, Bulach (CH)

( * ) Notice: Subject to any disclaimer, the term of this patent is extended or adjusted under 35 U.S.C. 154(b) by 0 days.

(21) Appl. No.: 10/474,789

(22) PCT Filed: Apr. 5, 2002

(86) PCT No.: PCT/EP02/03775

§ 371 (c)(1),
(2), (4) Date: Dec. 3, 2003

(87) PCT Pub. No.: WO02/081102

PCT Pub. Date: Oct. 17, 2002

(65) Prior Publication Data

US 2004/0112282 A1 Jun. 17, 2004

(30) Foreign Application Priority Data

Apr. 9, 2001 (DE) ..... 101 17 667

(51) Int. Cl.
*B05C 3/02* (2006.01)

(52) U.S. Cl. ..... 118/410; 118/325; 118/50; 118/DIG. 4

(58) Field of Classification Search ..... 118/50, 118/DIG. 4, 325, 410, 419; 162/363–374, 162/199; 277/345; 427/420, 294
See application file for complete search history.

(56) References Cited

U.S. PATENT DOCUMENTS 3,347,378 A * 10/1967 Arnold et al. ..... 210/106
4,441,263 A * 4/1984 Vedenpaa ..... 34/115
4,824,039 A * 4/1989 Muller et al. ..... 226/92
5,341,579 A * 8/1994 Schiel et al. ..... 34/115
6,162,502 A * 12/2000 Schweizer et al. ..... 427/294

* cited by examiner

*Primary Examiner*—Brenda A. Lamb
(74) *Attorney, Agent, or Firm*—Andrew Wilford

(57) ABSTRACT

A web to be coated travels over a deflecting roll and underneath a slot nozzle from which a curtain of a coating material falls. A suction box open toward the roll and web has upstream and downstream ends and extends full axial length of the roll. An upstream seal on the upstream side of the box is juxtaposed with the web, extends the full axial length of the roll, and has upstream and downstream edges extending transverse to the web-travel direction. A similar downstream seal is provided on the downstream side of the box juxtaposed with the web. The downstream-seal downstream edge is spaced upstream in the direction from where the curtain falls on the web. Air is withdrawn from the box between the seals to suctionally strip a boundary layer of air from the web between the seals.

9 Claims, 4 Drawing Sheets

APPARATUS FOR STRIPPING A BOUNDARY AIR LAYER FROM A TRAVELING WEB

CROSS REFERENCE TO RELATED APPLICATIONS

This application is the US national phase of PCT application PCT/EP02/03775, filed 5 Apr. 2002, published 17 Oct. 2002 as WO 02/081102, and claiming the priority of German patent application 10117667.8 itself filed 9 Apr. 2001.

FIELD OF THE INVENTION

The invention relates to an apparatus for suctionally stripping the boundary air layer off a web deflected over a roll as well as to a system for coating a traveling web that is provide with such a stripping apparatus.

BACKGROUND OF THE INVENTION

A traveling web, such as of paper or cardboard, plastic or metal foil, is coated by a so-called curtain coater which applies the coating material (glue dispersion, ink, etc.) as a curtain dropping from a slot nozzle onto the web. In order for the curtain coater to form a uniform coating it is essential that the curtain dropping from the slot nozzle be stable, not move, and not form bubbles on the web. Thus the boundary air layer that forms on the web at high web-travel speeds of more than 400 m/min creates problems. The boundary air layer adhering to the web creates irregular disturbances in the curtain and makes bubbles that create irregularities in the coating thickness.

A curtain coater in EP 0,489,978 for creating photographic materials has upstream of the slot nozzle a shield-like element ("air shield") which serves for stripping off the boundary air layer. The element is positioned near a deflecting roll for the web and extends in an arc over a predetermined angular portion of the deflecting roll. The element is constructed such that its upstream edge and downstream edge form zones in which the wind resistance is greater than in the zone between the two end regions. In the zone between the zones of greater wind resistance there is a chamber that is connected to a suction line to reduce its pressure. The spacing between the seal-like elements at the upstream and downstream edges and the deflecting roll is between 0.5 mm and 2 mm. The spacing between the downstream edge of the shield-like element and the curtain is between 5 mm and 30 mm.

OBJECT OF THE INVENTION

It is an object of the invention to provide an apparatus that makes it possible to reduce the boundary air layer on a wide (2 m and more) web at high web-travel speed (1000 m/min and more) such that a curtain coater provided downstream applies the coating material uniformly.

SUMMARY OF THE INVENTION

This object is attained in that a suction box is provided at the deflecting roll and has the following features:

The suction box extends a full axial length of the deflecting roll, is open toward the deflecting roll, and is connected to the intake of a fan;

It has upstream and downstream seals that form respective gaps with the web and extend the full axial length of the deflecting roll, at least the downstream edge of the upstream seal and the upstream edge of the downstream seal being positioned where the web is deflected around the deflecting roll;

The suction box has at each axial end face of the deflecting roll an end seal that is parallel to and extremely closely spaced from the respective end face;

The downstream seal forms with the web a downstream gap whose height and width measured in the web travel direction are generally constant over the entire length of the suction box, this width being more than 10 mm, preferably more than 30 mm and in particular 50 mm–70 mm, and the gap having a dimension selected depending on the web travel speed such that the product of the web-travel speed (m/min)×gap width (in mm) is less than 1500.

According to the invention instead of the "air shield" there is a suction box that suctionally strips off the boundary air layer. It has been determined that the effectiveness is highly dependent on the shape and orientation of the downstream seals. They are set in accordance with the web-travel speed such that the boundary air layer on the web and at the ends of the deflecting roll is largely eliminated downstream of the seal. the curtain of coating material of a curtain coater provided in this region is thus not disturbed.

BRIEF DESCRIPTION OF THE DRAWING

In the following the invention is more closely described with reference to embodiments that are schematically shown in the drawing, wherein.

SPECIFIC DESCRIPTION

Figure 1:
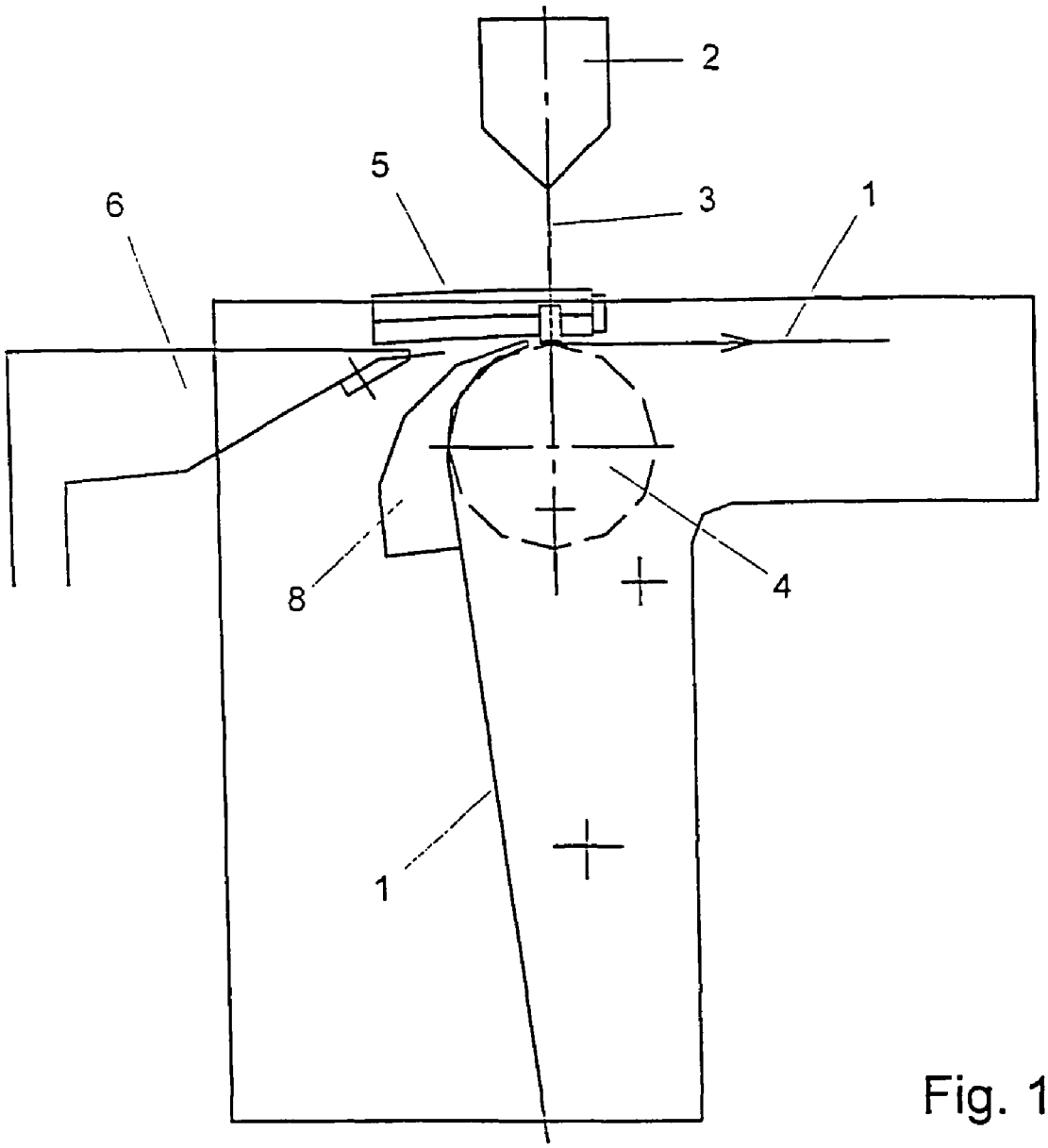
FIG. 1 is a side view of a curtain-type coating system where the slit nozzle is set so that the curtain falls on an apex line of a deflecting roll supporting the web.

The coating system shown in the drawing serves for applying a dispersion-type adhesive (e.g. an acrylate) in an aqueous solution to a siliconized paper web 1. As a result of its advantageous features the system can also serve for applying other dispersions to paper, plastic foils, or thin strips or to coat paper or cardboard webs with ink.

The coating system has a slot nozzle 2 that is suspended above the path of the web 1 in a frame. The slot nozzle 2 is connected to a supply of coating material and has on its lower side an outlet slot from which the coating material passes as a free-falling curtain 3 that lands on the web surface. The width of the slot nozzle is greater than the width of the web 1 being coated. Upstream of the slot nozzle 2 the web 1 passes around a deflecting roll 4 whose axial length extends over the entire working width of the coating system, that is the maximum width of a web 1 that can be coated.

At both axial ends of the coating system underneath the slot nozzle 2 are edge troughs 5 that limit the curtain 3 to the desired coating width. The edge troughs are both hung from the frame of the nozzle 2 so that they can move in or against the web-travel direction with the nozzle 2. The edge troughs 5 catch the coating material at the curtain ends and conduct it to a collection pan 6. The collection pan 6 is provided immediately upstream of the deflecting roll 4.

Figure 3:
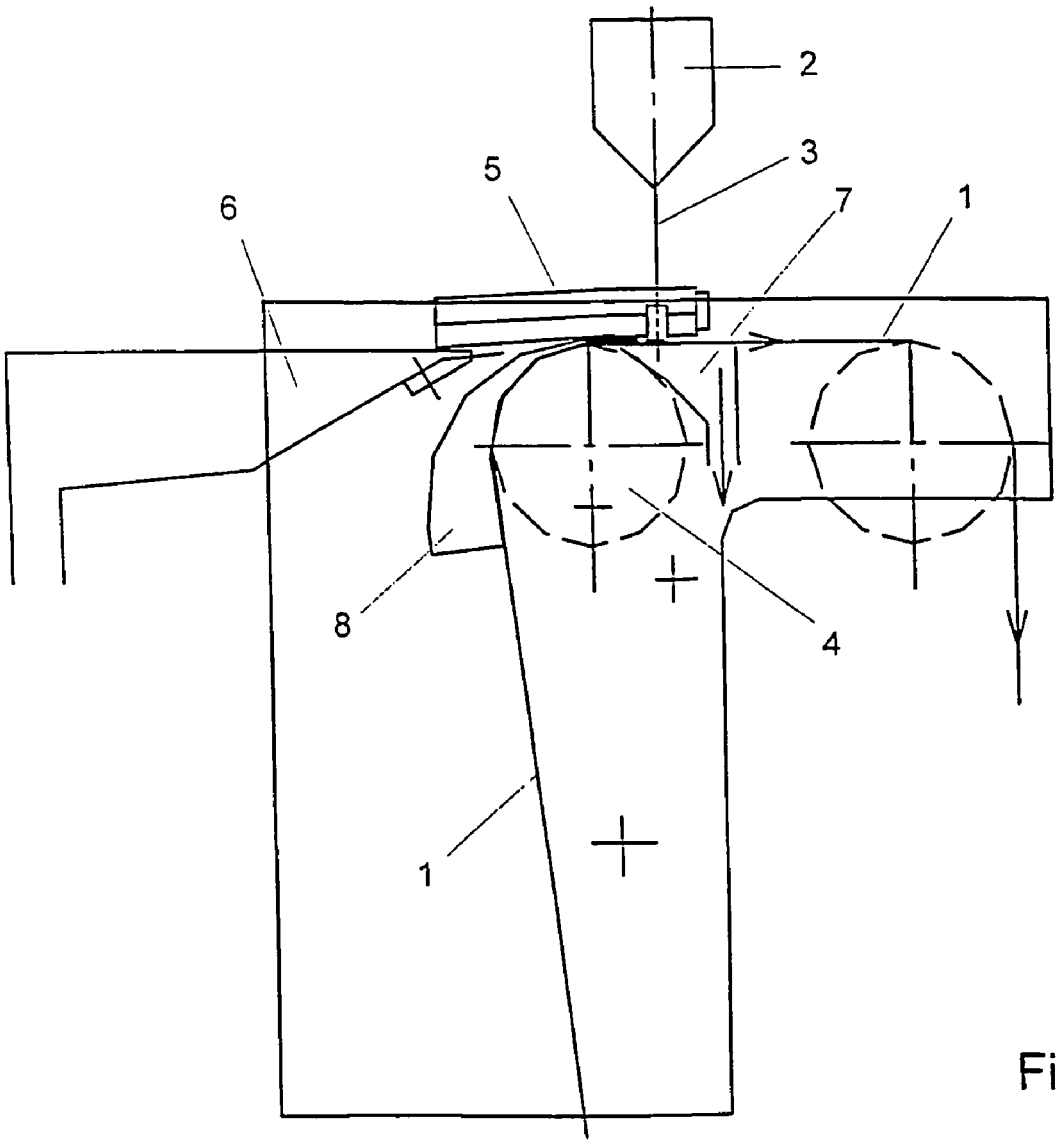
FIG. 3 is a curtain-type coating system where the curtain of coating material falls on the web downstream of the deflecting roll.

When the coating process is started the slot nozzle 2 and the parts carried on it are moved above the collection pan 6. Then at first a stable curtain 3 is produced that drops into the collection pan 6. Subsequently the slot nozzle 2 is moved into its working position above the deflecting roll 4 (FIG. 1) or somewhat downstream therefrom (FIG. 3).

The embodiment of FIG. 1 serves to apply a coating with a width smaller than the web width. Thus the coated web 1 has coating-free edges. In the embodiment according to FIG. 3 the web 1 is coated over its entire width. The curtain 3 is therefore wider than the web 1. The slot nozzle 2 in its working position is downstream of the apex line of the deflecting roll 4 so that a pan 7 can be positioned underneath the curtain 3 to catch the coating material falling past the web edges. The web 1 is fed horizontally to the region underneath the slot nozzle 2 and then is deflected downward over a second deflecting roll 8.

Figure 2:
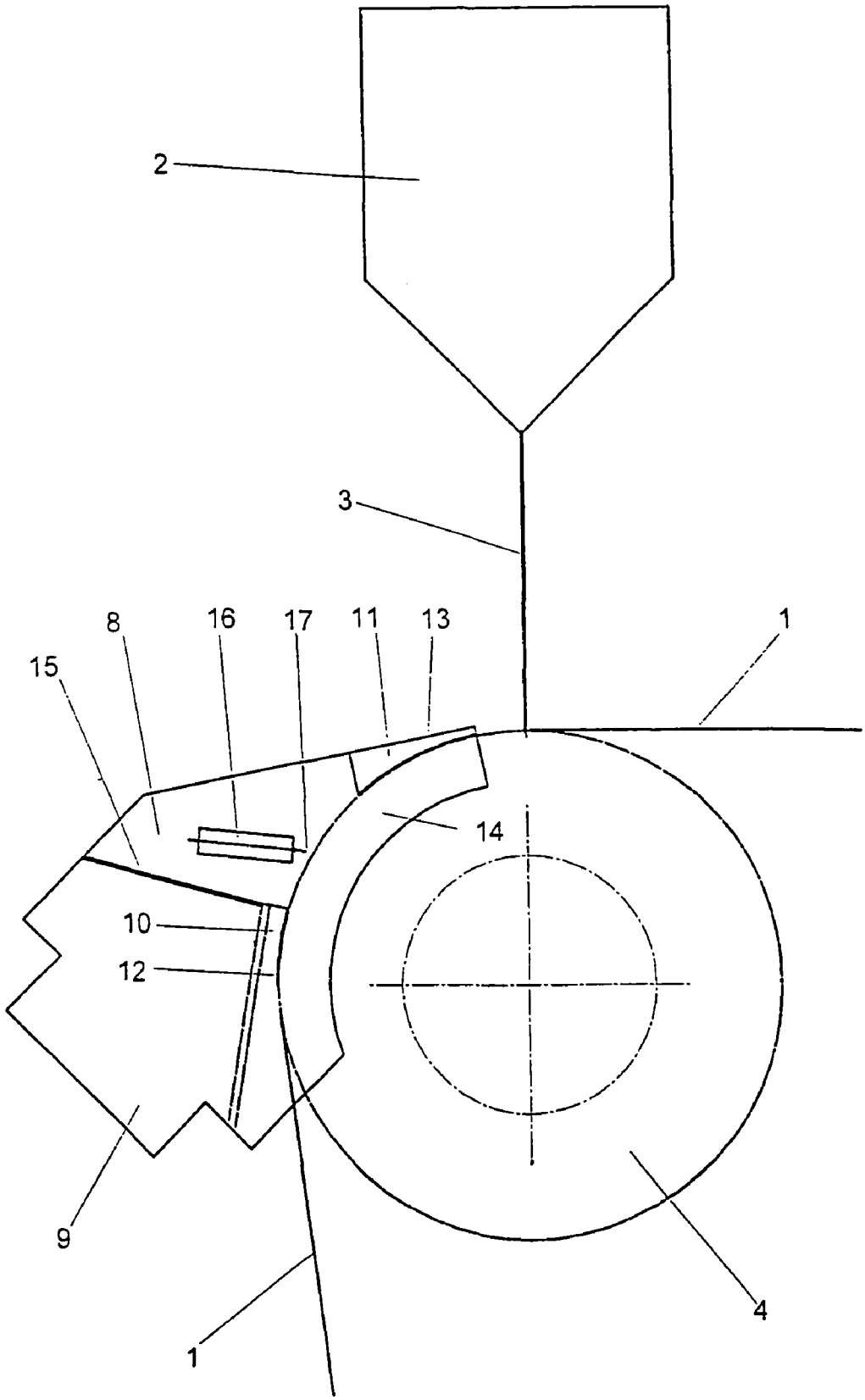
FIG. 2 is a large-scale view of the apparatus for suctioning off the air boundary layer.
Figure 4:
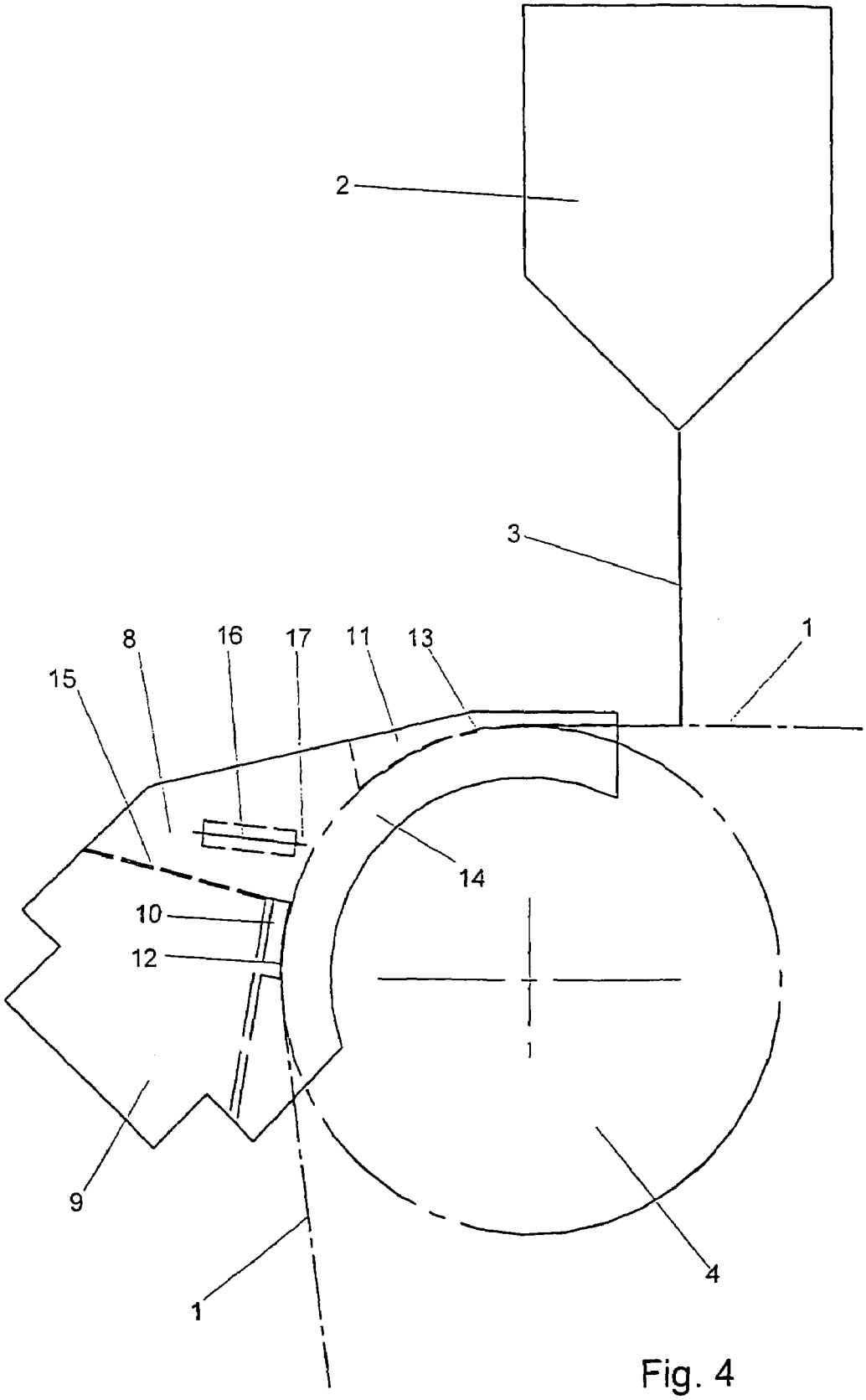
FIG. 4 is the suctioning apparatus for the curtain coater of FIG. 3 in enlarged scale.

In order to suctionally strip the air boundary layer off the web 1 and the edges of the deflecting roll 4 there is a vacuum apparatus spaced upstream in the web-travel direction from the slot nozzle 2 as shown in large scale in FIGS. 2 and 4.

A suction box 8 in the deflection region of the deflecting roll 4 is open toward the deflecting roll 4, to the web 1, and is connected via a suction line 9 in its rear wall to the intake of a fan. The suction box 8 is long enough to extend over the entire axial length of the deflecting roll 4. It has on is its upstream side an upstream seal 10 and on its downstream side a downstream seal 11 that each extend over the full axial length of the deflecting roll 4 and form respective gaps 12 and 13 with the web 1. At least the downstream edge of the upstream seal 12 and the upstream edge of the downstream seal 13 are positioned in the region where the web 1 is deflected by the deflecting roll 4. At each end of the deflecting roll 4 the suction box 8 has an end seal 14 that extends externally parallel at a very close spacing with the end face. For sufficient sealing at the end faces the seal elements 14 have lengths measured radially of the deflecting roll or at least 10 mm, preferably more than 15 mm, at the ends of the deflecting roll 4.

The downstream seal 11 is so constructed and arranged that it forms with the web 1 the downstream gap 13 whose width measured parallel to the web travel direction and height are generally constant over the entire width of the suction box, that is over the entire axial length of the deflecting roll 4. The width of the downstream gap 13 is more than 10 mm, preferably more than 30 mm and in particular 50 mm to 70 mm. The height of the downstream gap 13 is set according to the web travel speed such that the value of the product of web speed (in m/min)×gap height (in mm) is smaller than 1500. With a web travel speed of 1000 m/min the gap height is thus less than 1.5 mm.

The distance along the roll surface between the downstream edge of the upstream seal 10 and the upstream edge of the downstream seal 11 is more than 10 mm, preferably 50 mm–500 mm. In this region the boundary air layer is suctioned off the web 1 by the subatmospheric pressure in the suction box 8. It has been seen that the vacuuming is improved when the upstream seal 10 and the downstream seal 11 are constructed such that they have sharp edges at their respective upstream and downstream edges. At least the downstream seal 11 is thus sharp at its upstream and downstream edges, and preferably the upstream seal 10 has at least at its downstream edge a similar sharp edge.

For uniform distribution of the subatmospheric pressure in the suction box 8, it has at least one partition wall 15 formed with a uniform array of holes and extending the full width of the suction box 8. Preferably the partition 15 is formed by a perforated plate that subdivides the suction box 8 into a rear compartment having the suction line 9 and a front compartment that is open toward the web 1. The partition 15 also serves to rigidify the structure of the suction box 8.

In order to better strip the air boundary layer the suction box 8 is provided with a corona-charge electrode 16 that is connected to a high-voltage source. Such a corona-charge electrode and its use in separating gaseous laminar boundary layers are described in detail in EP 0,837,824. The deflecting roll 4, which is grounded and formed of a conductive material, typically metal, forms a counter electrode on the opposite web side. The charge electrode 16 extends over the full width of the suction box 8 and has a row of parallel points 17 directed at the web 1. The applied high voltage causes the points 17 of the charge electrode 16 to emit electrons or positrons that create turbulence in the boundary air layer and thus cause it to spin off. The points 17 are spaced as closely as possible from the web, with a spacing from the web 1 of 0.1 mm–10 mm, preferably 1 mm–5 mm. The spacing transverse to the web between adjacent points 17 is about 5 mm.

In the coating systems shown in FIGS. 1 and 3 the suction box 8 is positioned such that the distance from the downstream edge of the downstream seal 11 to the curtain 3 produced by the slot nozzle 2 is 10 mm–200 mm, preferably 20 mm–70 mm. Such a spacing not only ensures that no new boundary air layer can form that would disturb the curtain 3, but also prevents disturbances of the curtain 3 by sucking in air through the downstream gap 13. In order that in the coating system according to FIG. 3 the small distance from the downstream seal 11 to the curtain 3 can be maintained, the suction box 8 used there and in FIG. 4 is extended at its downstream end. The downstream end of the suction box 8 with the downstream seal extends substantially past the apex line of the deflecting roll 4.

Advantageously the upper wall of the suction box 8 is constructed such that it only projects slightly above the periphery of the deflecting roll 4. This makes it possible to mount the edge troughs 5 above the suction box and directly above the web path so that they can be inclined downward opposite the web-travel direction so that the caught coating material runs into the pan 6. Preferably the suction box 8 can be pivoted away from the deflecting roll 4 so that a new web can be loaded into the coating system. In addition in this manner the front side open toward the web 1 is made accessible for servicing.

The invention claimed is:

1. In a coating system where a web to be coated travels in a web-travel direction at a web-travel speed v in an arc over a deflecting roll and underneath a slot nozzle from which a curtain of a coating material falls on the traveling web, an apparatus for stripping a boundary-air layer from the web, the apparatus comprising:

a suction box juxtaposed with and open toward the roll and web at the arc and having upstream and downstream sides and ends, the box extending a full axial length of the roll;

an upstream seal on the upstream side of the box juxtaposed with the web at the arc, extending the full axial length of the roll, and having upstream and downstream edges extending transverse to the web-travel direction;

a downstream seal on the downstream side of the box juxtaposed with the web at the arc, extending the full axial length of the roll, and having upstream and downstream edges extending transverse to the web-travel direction, the downstream-seal down-stream edge being spaced upstream in the direction from where the curtain falls on the web, the downstream seal having an inner face directed radially at the roll and spaced substantially uniformly over its entire surface area from the roll; and end seals on the box between the upstream and downstream seals and closely axially juxtaposed with axially directed end faces of the roll;

means for withdrawing air from the box between the seals and thereby suctionally stripping a boundary layer of air from the web between the seals;

a corona-charge electrode in the box having a row of points with tips equispaced from the web; and a high-voltage source connected to the points.

2. The coating system defined in claim 1 wherein the box is provided with a partition formed with an array of through-going holes and subdividing it into a rear compartment connected to the means and a front compartment open toward the roll.

3. The coating system defined in claim 1 wherein the tips are spaced radially 0.01 mm–10 mm from the web.

4. The coating system defined in claim 1 wherein the tips are spaced radially 1 mm–5 mm from the web.

5. The coating system defined in claim 1 wherein the inner face has a width w measured parallel to the web travel direction equal to more than 10 mm and is spaced from the web by a distance d according to the formula d(mm)×v(m/min)<1500.

6. The coating system defined in claim 5 wherein the width w is equal to 50 mm–70 mm.

7. The coating system defined in claim 5 wherein a spacing s in the web-travel direction between the downstream-seal downstream edge and where the curtain falls on the web is greater than 10 mm.

8. The coating system defined in claim 7 wherein the spacing s is equal to 50 mm–500 mm.

9. The coating system defined in claim 5 wherein the end seals radially overlap the respective end faces by at least 10 mm.

* * * * *